US007659703B1

(12) United States Patent
Fesler et al.

(10) Patent No.: US 7,659,703 B1
(45) Date of Patent: Feb. 9, 2010

(54) ZERO GENERATOR FOR VOLTAGE REGULATORS

(75) Inventors: Robert Eric Fesler, Saratoga, CA (US); Chunping Song, Santa Clara, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 38 days.

(21) Appl. No.: 11/251,483

(22) Filed: Oct. 14, 2005

(51) Int. Cl.
*G05F 1/00* (2006.01)

(52) U.S. Cl. ..... 323/273; 323/280

(58) Field of Classification Search ..... 323/280, 323/281, 279, 316, 317, 273
See application file for complete search history.

(56) References Cited

U.S. PATENT DOCUMENTS 4,484,148 A 11/1984 Wieser et al.
5,889,393 A * 3/1999 Wrathall ..... 323/280
6,518,737 B1 * 2/2003 Stanescu et al. ..... 323/280
6,522,112 B1 2/2003 Schmoock et al.
6,703,815 B2 * 3/2004 Biagi ..... 323/280
6,822,514 B1 * 11/2004 Aude ..... 330/260
7,166,991 B2 * 1/2007 Eberlein ..... 323/280
2005/0189930 A1 * 9/2005 Wu et al. ..... 323/280

OTHER PUBLICATIONS

Yuan et al., Low Dropoutvoltage Regulator for wireless applications, Feb. 2002, IEEE, PESC2002, p. 421-424.*
Di Cataldo, G., Ferri, G., and Pennisi, S., Active Capacitance Multipliers Using Current Conveyers, DEES (Dipartimento Eletttrico Ellettronico e Sistemistico), 1998, 4 pgs., Universita' Di L' Aquila, L' Aquila, Italy.

* cited by examiner

*Primary Examiner*—Bao Q Vu
*Assistant Examiner*—Jue Zhang
(74) *Attorney, Agent, or Firm*—Darby & Darby P.C.; Matthew M. Gaffney

(57) ABSTRACT

A circuit for providing an improved "feed forward" zero in a feedback loop such that the zero has a frequency dependent on the transconductance (gm) of a common gate transistor, and pole and zero separation that is dependent on a multiple of the gm. The circuit includes an error amplifier and a compensation circuit. The compensation circuit provides a first feedback current and a second feedback current. The error amplifier receives a reference signal and a feedback signal. The feedback signal is provided by summing the first feedback current and the second feedback current.

3 Claims, 3 Drawing Sheets

ZERO GENERATOR FOR VOLTAGE REGULATORS

FIELD OF THE INVENTION

The present invention relates to separating poles and zeros in the compensation scheme of an error amplifier in a closed loop. In particular, the present invention relates to a method and apparatus for generating a zero and providing amplifier compensation for low-dropout regulators.

BACKGROUND OF THE INVENTION

A low-dropout regulator, hereinafter an "LDO regulator," is useful in applications where it is desired to maintain a regulated voltage that is sufficiently close to the input voltage. For example, LDO regulators are useful in battery-powered applications where the power supply operates at a low voltage. Frequently, an LDO implementation will employ a compensation network to improve stability over the operating margins.

DETAILED DESCRIPTION OF THE PREFERRED EMBODIMENT

Figure 1:
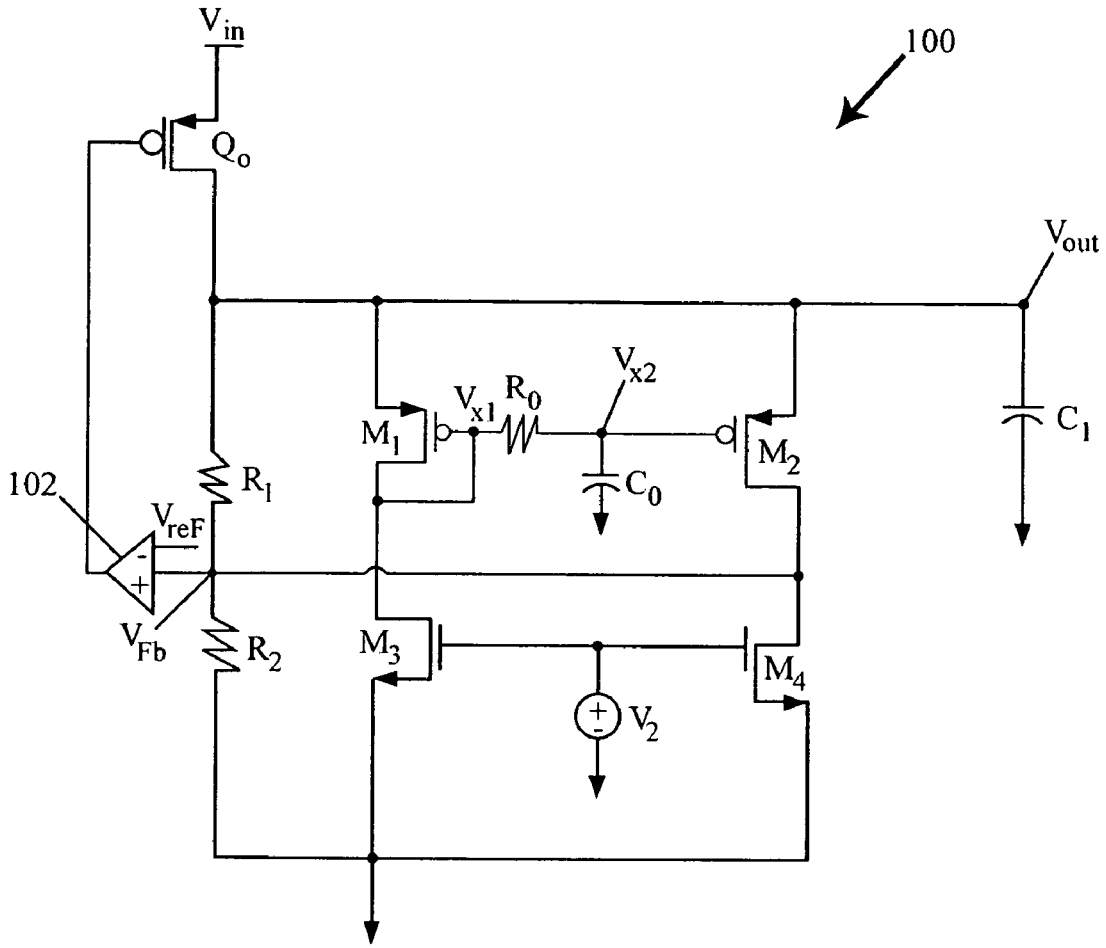
FIG. 1 is a schematic diagram illustrating an exemplary LDO voltage regulator with a compensation configuration.

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active of passive, that are coupled together to provide a desired function. Similar reference letters given to resistors and capacitors do not signify that these elements have the same values.

Briefly stated, aspects of the present invention are related to an apparatus and method for providing an improved "feed forward" zero in a feedback loop, the zero having a frequency dependent on the transconductance (gm) of a common gate transistor, and pole and zero separation that is dependent on a multiple of the gm. Among other things, the circuit is particularly useful in improving compensation, increasing stability and reducing the capacitor size in the compensation schemes for error amplifiers in closed loops, LDOs and voltage regulators with low output voltages.

An error amplifier is configured to receive a feedback signal and a reference signal and provide as output an error signal based on the feedback and reference signal. A pass element, i.e. PMOS transistor, is configured to receive the error signal and an unregulated power signal, and provide an output signal that corresponds to a regulated output voltage. A compensation circuit is arranged to provide the feedback signal. The compensation circuit includes a MOS current mirror circuit that provides an intermediary signal in response to the output signal. The intermediary signal is coupled to a feedback network which provides the feedback signal in response to the intermediary signal. The closed-loop transfer function of the compensation circuit provides a feed-forward zero that enables stable operation of the LDO regulator while allowing the feed forward capacitor to be smaller in size by a magnitude of gm as will be described in further detail below. As discussed above, the zero has a frequency dependent on the transconductance (gm) of a common gate transistor, and pole and zero separation that is dependent on a multiple of this gm.

FIG. 1 is a schematic diagram illustrating an embodiment of LDO voltage regulator 100 that is compensated for stable AC operation. The LDO voltage regulator 100 comprises a pair of NMOS transistors M3 and M4 which make up a common-source amplifier or first current mirror. The first current mirror is connected to a second current mirror comprising PMOS transistors M1 and M2. The second current mirror acts as the drain load and provides a high effective drain load resistance, increasing the gain.

In operation, an input voltage source that has a low source-impedance provides the supply voltage $V_{in}$, and a reference circuit (not shown) is arranged to provide the reference voltage $V_{ref}$. A voltage divider circuit comprising R1 and R2 is connected between $V_{out}$ and the common source of M3 and M4. The current through the R1, R2 resistive divider is assumed to be negligible compared to the load current. A feedback loop which controls the output voltage is obtained by using R1 and R2 to "sense" the output voltage and applying the sensed voltage (Vfb) to the non-inverting input of error amplifier 102. The inverting input of error amplifier 102 is tied to reference voltage Vref, such that error amplifier 102 adjusts its output voltage (and the current through Q0) to force the voltages at its inputs to be equal. The feedback loop holds the regulated output (Vout) at a fixed value relatively independent of changes in load current. A sudden increase or decrease in load current demand can cause the Vout voltage to change until the feedback loop can correct and stabilize to the new level.

A compensation circuit to stabilize the AC performance of LDO voltage regulator 100 is formed by the combination of R1, R2, M1-M4. The drain of M2 provides a feedback signal $V_{fb}$ across R2. By analyzing the relationship between the feedback signal $V_{fb}$ and the output signal $V_{out}$ in the AC domain, the stability of voltage regulator 100 is determined. Specifically, assuming M1's pole and zero are far away from other dominant poles and zeros, the general form of feedback signal Vfb is given by:

$$V_{fb}(s) = \frac{R_2}{R_1 + R_2} \cdot \frac{1 + R_0C_0(1 + gmR_1)s}{1 + R_0C_0s} V_o(s)$$

Solving for the pole and zero frequencies of feedback signal $V_{fb}$ yields:

$$F_z = \frac{1}{2\pi R_0 C_0 (1 + gmR_1)} \quad F_p = \frac{1}{2\pi R_0 C_0}$$

The complete derivation for $V_{fb}(s)$ is as follows:

$$V_o(s) = V_{x1}(s)$$

$$V_{x2}(s) = \frac{1/sC_0}{R_0 + 1/sC_0} V_o(s) = \frac{1}{1 + R_0 C_0 s} V_o(s)$$

$$i_s(s) = \left[V_o(s) - \frac{1}{1 + R_0 C_0 s} V_o(s)\right] g_m = \frac{g_m R_0 C_0 s}{1 + R_0 C_0 s} V_o(s)$$

$$V_{fb}(s) = V_o(s) \frac{R_2}{R_1 + R_2} + i_s(s)[R_1 // R_2]$$

$$V_{fb}(s) = \frac{R_2}{R_1 + R_2} \cdot \frac{1 + R_0 C_0 (1 + g_m R_1) s}{1 + R_0 C_0 s} V_o(s)$$

The LDO regulator compensation scheme of FIG. 1 enables a wide range of compensation to be utilized while maintaining the phase margin. As illustrated, the circuit generates a zero from the output node $V_{out}$ of the regulator to the feedback node $V_{fb}$ and by properly adjusting $gmR_1$ the stability of LDO voltage regulator 100 can be adjusted.

The compensation circuit operates as follows. M3 creates a current through M1 which gets biased out, making M1's source and gate swing together if there is an AC signal on Vout. The low pass filter, made up of R0 and C0, prevents the gate of M2 from following the change in $V_{out}$, leaving Vx2 unaffected. Accordingly, the gate of M1 follows a change at $V_{out}$, and as $V_{out}$ increases with frequency a zero is created. The transconductance of M2 gains up Vout. Additionally, during low frequencies, Vx2 and Vout move up and down together. In the midband, Ro and Co create a reduction in Vx2 such that the gain of M1 creates a zero. Once Ro and Co have substantially attenuated Vx2, a pole that follows the zero remains.

A review of the above pole and zero equations reveals that the frequency of the zero is a function of R0, C0, R1 and the gm of M1. At higher frequencies, Vx2 (FIG. 1) becomes effectively AC ground and the current in M1 substantially ceases to rise with frequency. The embodiment shown in FIG. 1 allows $C_0$ to be relatively small while permitting resistances for R1 that do not generally create an additional pole at op-amp 102. Additionally, the pole and zero separation is dependent on $g_m R_1$. With a large separation between the pole and zero, the LDO voltage regulator 100 may be operated under a wide variety of load conditions without instability and for low values of $V_{out}$.

LDO regulator 100 may be utilized at lower voltages since it is unity gain stable. Output capacitor C1 is employed to force the gain to roll off fast enough to meet the stability requirements. Also, a low cost capacitor that is low-ESR can be used for C1 to keep the zero frequency high enough to avoid regulator instability.

The compensation configuration illustrated in FIG. 1 provides for a zero in the feedback signal with a fractionally associated pole. A review of the above pole and zero equations reveals that the frequency of the zero may be a predetermined fraction of the pole frequency by appropriately choosing the network elements R1 and gm. In practice, embodiments of the invention may be applied to tailor the pole-zero relationship for specific applications that require such LDO operational parameters as extra low voltage operation, or highly reactive loads for example.

The embodiment of the invention shown in FIG. 1 illustrates an approach to compensating voltage regulators for stable operation. The example is presented as but one of a multiplicity of embodiments and does not reflect all possible combinations for network elements as are within the scope of the invention.

Figure 2:
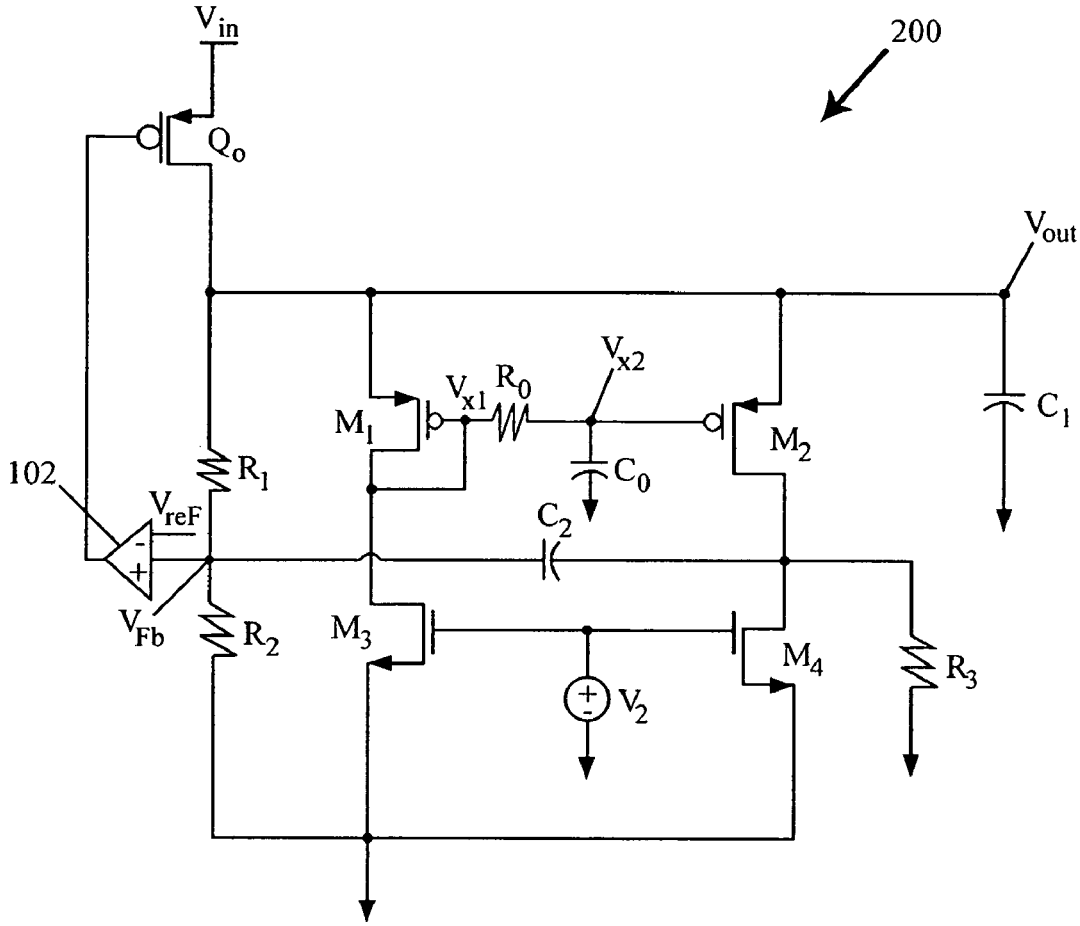
FIG. 2 is a schematic diagram illustrating another embodiment of the LDO voltage regulator with the compensation configuration.

FIG. 2 illustrates another embodiment of the invention that is substantially similar to the LDO voltage regulator of FIG. 1, albeit different in providing AC coupling to improve DC accuracy. Device size mismatches in M1-M4 of the compensation circuit in FIG. 1 create a DC offset in $V_{out}$. Referring to FIG. 2, R3 and C2 enable DC offsets to be substantially eliminated. R3, sized to allow operating headroom at the worst case offset voltage, is connected between the drain of M2 and ground. C2 is connected between the non-inverting input of op-amp 102 and the drain of M2. C2 is sized so that the pole generated by R3, R1 and C2 is sufficiently low so as not to interfere with ideal operation of the LDO, and is preferably very small. The operation of transistors M1-M4 are substantially the same as described above with respect to the embodiment shown in FIG. 1.

Finally, an advantage of the invention as described above is the freedom to employ components such as load and bypass low-ESR capacitors. Such an advantage provides cost and design savings, allows for a low component count, small cap size and high speed and independently controlled pole/zero location and separation.

Figure 3:
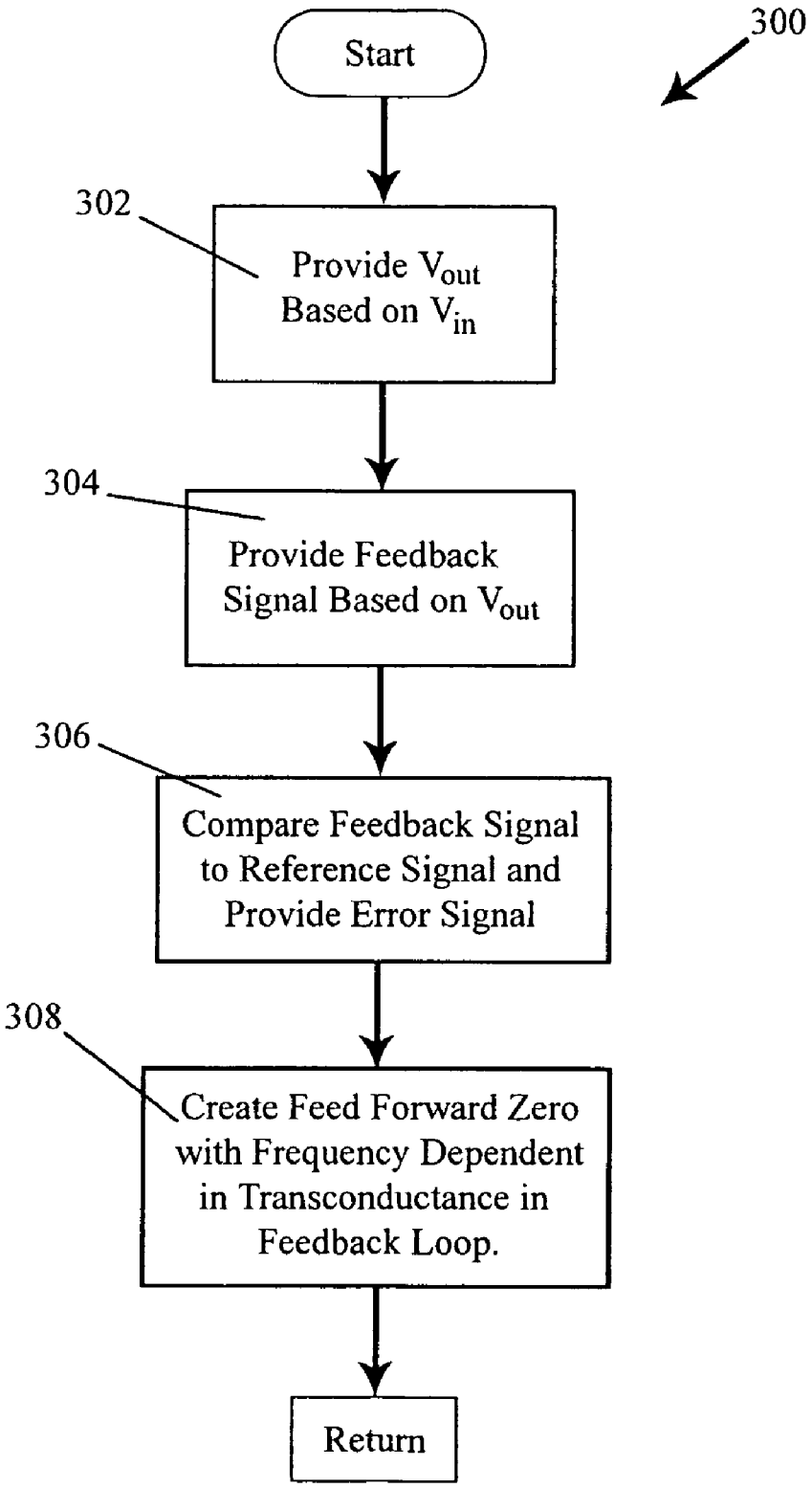
FIG. 3 is a flowchart for a process to compensate for the operation of an LDO regulator, in accordance with the invention.

FIG. 3 illustrates a flowchart for process 300 for compensating the operation of an LDO regulator. Moving from a start block, the process advances to block 302 where an output voltage is provided to an error amplifier based on an input voltage. Stepping to block 304, a feedback signal is provided based on the output voltage. Next, at block 306, the feedback signal is compared to a reference signal to provide an error signal.

Flowing from block 306, the process moves to block 308 and the ability of the error amplifier is compensated by creating a zero in a closed loop transfer function. This zero is a feed-forward zero with a frequency that is dependent on a defined transconductance of an element in a feedback loop. Next, the process returns to performing other actions.

In one embodiment, the process provides for creating a pole in the closed loop transfer function and the feedback loop is subsequently arranged to provide a zero with a frequency that corresponds to a fraction of the pole frequency. Also, for at least one embodiment, the process activates a pass circuit in response to the control signal such that power is coupled from a power supply to an output node when the pass circuit is active.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for providing at least one pole and at least one zero with independent pole and zero frequency separation, comprising:

an error amplifier having at least a first input that is coupled to a reference node, a second input that is coupled to a feedback node, and an output that is coupled to a control node;

a first circuit that is arranged to provide a first current to the feedback node based, at least in part, on a voltage at an output node; and a second circuit that is arranged to provide a second current to the feedback node based, at least in part, on a voltage at the output node, wherein the first circuit and the second circuit are arranged to provide a zero at a first frequency and to provide a pole at a second frequency, wherein a closed loop transfer function $V_{fb}(s)$ is given by:

$$V_{fb}(s) = K \cdot \frac{1 + R_0C_0(1 + g_mR_1)s}{1 + R_0C_0s} V_o(s)$$

wherein R1 is a value of a first resistance associated with the first circuit, gm is a value of a transconductance associated with the first circuit, R0 is a value of a resistance associated with the second circuit, C0 is a value of a capacitance associated with the second circuit, and K is the gain of the error amplifier, and wherein the first circuit and the second circuit are further arranged to provide independent control of the location of the zero and the location of the pole.

2. The apparatus of claim 1, wherein the first frequency Fz is substantially equal to:

$$F_z = \frac{1}{2\pi R_0C_0(1 + g_mR_1)}, \text{ and}$$

and wherein the second frequency Fp is substantially equal to:

$$F_p = \frac{1}{2\pi R_0C_0},$$

wherein R1 is a value of a first resistance associated with the first circuit, R0 is a value of a resistance associated with the second circuit, C0 is a value of a capacitance associated with the second circuit, and gm is a value of a transconductance associated with the first circuit.

3. The apparatus of claim 1, wherein the separation between the first frequency and the second frequency is substantially equal to:

$$\frac{1}{(1 + g_mR_1)},$$

wherein R1 is a value of a first resistance associated with the first circuit, and gm is a value of a transconductance associated with the first circuit.

* * * * *